United States Patent [19]

Orphall

[11] Patent Number: 4,679,740

[45] Date of Patent: Jul. 14, 1987

[54] WEDGE-CLAMP ASSEMBLY FOR AN IMPACT CRUSHER

[75] Inventor: Axel W. Orphall, McMurray, Pa.

[73] Assignee: Stedman Machine Co., Aurora, Ind.

[21] Appl. No.: 816,181

[22] Filed: Jan. 6, 1986

[51] Int. Cl.[4] ..... B02C 13/28

[52] U.S. Cl. ..... 241/189 R; 241/192; 241/294

[58] Field of Search ..... 241/189 R, 191, 192, 241/195, 241, 293, 294

[56] References Cited

U.S. PATENT DOCUMENTS 3,531,055 9/1970 Alt .
3,784,117 1/1974 Koenig et al. .
3,874,603 4/1975 Lowe .
4,573,643 3/1986 Orphall .

FOREIGN PATENT DOCUMENTS 2916649 11/1979 Fed. Rep. of Germany .

*Primary Examiner*—Timothy V. Eley
*Attorney, Agent, or Firm*—Arnold B. Silverman; Suzanne Kikel

[57] ABSTRACT

A wedge and clamp device for retaining a wedge in a slot of a disc and against a breaker bar of a rotor assembly in an impact crusher. The clamping arrangement comprises a sleeve which is placed inwardly in the slot, two plates each mounted along the opposed outer faces of the disc in alignment with the sleeve and a bolt extending through the sleeve and two plates. The wedge has a U-groove along its top surface to receive the opposite edges of the disc, and the two plates overlap the wedge so that the wedge can move in a direction out of the slot to increase the holding force against the breaker bar during operation of the crusher.

12 Claims, 4 Drawing Figures

SECTION-4-4

WEDGE-CLAMP ASSEMBLY FOR AN IMPACT CRUSHER

BACKGROUND OF THE INVENTION

1. Field of the Invention

The present invention relates to an impact crusher having a support member subject to rotational motion during the operation of the crusher, and carrying a breaker bar which is subject to centrifugal forces and employed for comminuting particulate material, such as rock, ore, limestone, grain, concrete or the like. More particularly, it pertains to an improved means for securing the breaker bar to the support member.

2. Description of the Prior Art

In impact crushers, it is well known to provide a rotor with several replaceable breaker or impact bars mounted onto the periphery of the rotor, which may be of the open disc-type consisting of generally several discs mounted on a rotatable shaft. In the present open disc-type rotor, both the back-up bar and breaker bar extend between opposed discs. The back-up bar is welded in the opposed discs, and may either have an angular protrusion which fits into a similarly formed depression in the breaker bar as shown in U.S. Pat. No. 3,531,055 or may have an angularly formed depression for receiving a similarly formed protrusion of the breaker bar. The breaker bar is held in position by inserting a breaker bar holder or shoe against a nose of the disc between the breaker bar and disc.

During rotation of the shaft and discs, severe centrifugal forces are exerted against the sloped protrusions and depressions in the breaker bar or back-up bar, and/or severe lateral forces are ultimately exerted against the shoe resulting in a skewed seating for the breaker bar, and thus, reduced contact support between the breaker bar with a bottom edge of the shoe and also between the breaker bar with an upper edge of the back-up bar and between the depression and protrusion area of the breaker bar and back-up bar to the extent that there will exist insufficient support and eventual damage to the back-up bar protrusion and the disc nose.

Also, in the past designs due to the environment under which the machine is operated, the constant pounding and the centrifugal forces, the removal of the breaker bar results in a costly, time-consuming, and exertful task.

This present design for replaceable breaker bars is extremely unconducive in establishing and maintaining self-alignment of the back-up bar, breaker bar, and shoe, and frequently results in deformation of the back-up bar and the rotor disc nose which are normally considered to be non-replaceable components. This deformation condition of the back-up bar and disc nose often requires repair by weld built-up or machining of these fixed parts, which translates into extended downtime of the impact crusher and excessive maintenance manpower hours.

Other mounting arrangments for the breaker bar of the open disc type rotor assemblies for impact crushers have developed such as that disclosed in the applicant's patent application bearing U.S. Ser. No. 596,210 filed Apr. 2, 1984, which recently has been allowed and in German patent application No. 2,916,649 filed Apr. 25, 1979; the latter arrangement still having the tendency to cause a skewed seating for the breaker bar which tendency has been eliminated in the former reference. In spite of these foregoing arrangements there remains a need for an improved mechanism for mounting the breaker bar in the discs of the impact crushers.

SUMMARY OF THE INVENTION

The present invention has met the above-described needs in a simple, efficient, and economical manner. In a preferred embodiment, a clamping or mounting mechanism holds a wedge member against a breaker bar in a slot of an open-type disc of a rotor assembly of an impact crusher. The slot has an inner sloped surface corresponding to the sloped surface of the wedge member, and which extends into an enlarged area toward the center of the disc to receive and support both a sleeve with a bolt, which supports the wedge member in the slot. This enlargement defines the most inward position of the wedge member and the required opening in the slot for removing and inserting of the breaker bar and the slot provides the required clearance between the breaker bar and the back-up bar for its removal and insertion. Mounted along the two opposed faces of the disc on opposed ends of the bolt is a restraining plate which overlaps the enlarged area of the slot and the wedge member. These restraining plates, in addition to a groove along the sloped surface of the wedge which receives the sloped edge of the disc, prevents the wedge from moving axially of the disc, and thus, allows outward radial movement thereof upon rotation of the rotor assembly.

It is a further object of the present invention to provide a mounting or clamping means for a wedge member which is simple in construction and inexpensive in its manufacturing costs.

The preferred embodiment of the present invention provides an improved design for an impact crusher which substantially decreases the downtime of the crusher and lessens the manpower hours involved in present day impact crushers and more particularly to provide a mounting arrangement for the breaker bar such that it allows for easy removal and replacement of the breaker bar.

It is a further object of the present invention to provide a mounting means which accommodates varying lengths of the wedge member for an adequate locking position for the breaker bar prior to rotation of the rotor assembly for comminuting of the material.

More particularly, it is an object of the present invention to provide a tubular member or sleeve for abutting the wedge, whose diameter or wall thickness is selected depending on the length of the wedge for its proper initial positioning against the breaker bar.

These and other objects and advantages of the present invention will be more fully understood and appreciated when the following description of the invention is read along with the accompanying drawings of which:

DETAILED DESCRIPTION OF A PREFERRED EMBODIMENT

The principles, operation, and basic construction of an impact crusher are set forth in U.S. Pat. Nos. 3,531,055; 3,623,674; 3,847,362; and 4,017,035, and the above mentioned recently allowed patent application issuing to the applicant. The applicant's recently allowed patent application bearing U.S. Ser. No. 596,210 filed Apr. 2, 1984 is incorporated herein by reference.

Figure 1:
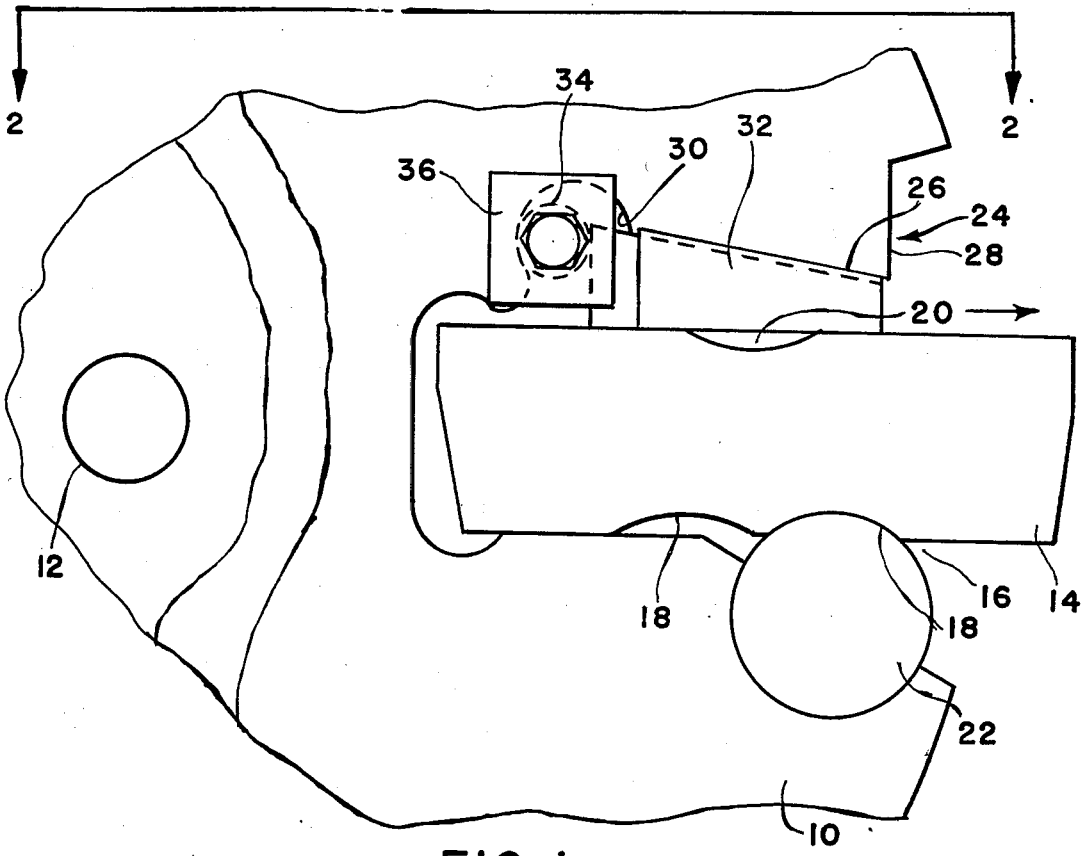
FIG. 1 is a front, elevational view of the present invention, illustrated with reference to one of the breaker bars of an impact crusher partly broken away for brevity.

Referring to FIG. 1, there is shown a support member or disc 10 which is mounted on a rotor shaft 12. Disc plate 10 may be one of several cooperative discs mounted on the rotor shaft 12 for supporting a breaker bar 14 at its opposed ends in a housing of an impact crusher and of the open-disc type. Breaker bar or impact element 14 may be one of several mounted on a rotor assembly for disintegrating or comminuting material particulates, such as limestone, grain, ore, etc.

Breaker bar 14 is received in an open recess or slot 16 of disc 10, which slot 16 is radially located with respect to rotor shaft 12 on an outer circumferential periphery of disc 10. Breaker bar 14 is provided with circular arc shaped grooves 18, 20 along its two opposed longitudinal sides as shown in FIG. 1, and which, as shown, one of grooves 18 partially encircles a circular back-up bar 22 permanently connected for example by welding in disc 10.

Arc-shaped grooves 18, 20 are used in conjunction with back-up bar 22 to register and fix breaker bar 14 in slot 16, which back-up bar 22 extends the length of breaker bar 14 across the width of the housing of the impact crusher for support of breaker bar 14 by back-up bar 22. Once breaker bar 14 is fixed in disc 10 it is retained therein by a wedge-clamp assembly 24 shown in FIG. 1.

Attention is drawn to the particular configuration of the portion of slot 16 in disc 10 into which clamp assembly 24 is mounted. With breaker bar 14 and back-up bar 22 in their proper positioning in slot 16 as shown in FIG. 1, slot 16 has an inner sloped surface 26 extending from an outer edge 28 of disc 10 inwardly toward shaft 12 a distance which then flares out into a semi-circular enlargement area 30 adjacent the wider opening of the slot 16 where breaker bar 14 is positioned and which as shown in FIG. 1 is next to the clamp assembly 24.

Figure 2:
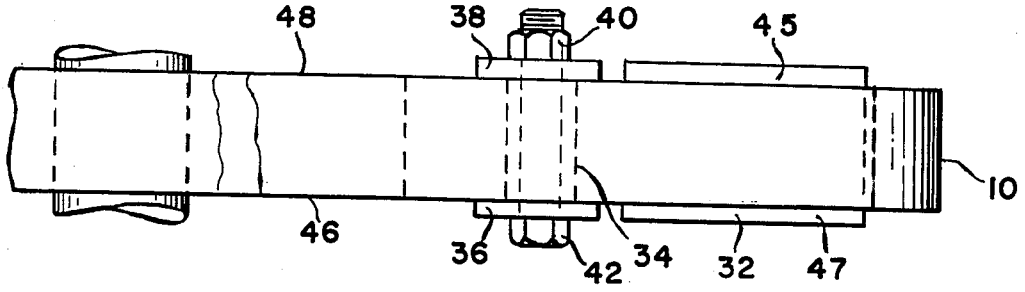
FIG. 2 is a side view taken along lines 2—2 of FIG. 1, in which the breaker bar has been omitted.

Referring to both FIGS. 1 and 2, wedge-clamp assembly 24 which essentially is the present invention consists of a steel wedge member 32, a steel sleeve 34, two steel rectangular plates 36 and 38, and a nut 40 and bolt 42, which bolt 42 extends through plates 36, 38 and sleeve 34 in the semi-circular enlargement 30 of slot 16.

Figure 3:
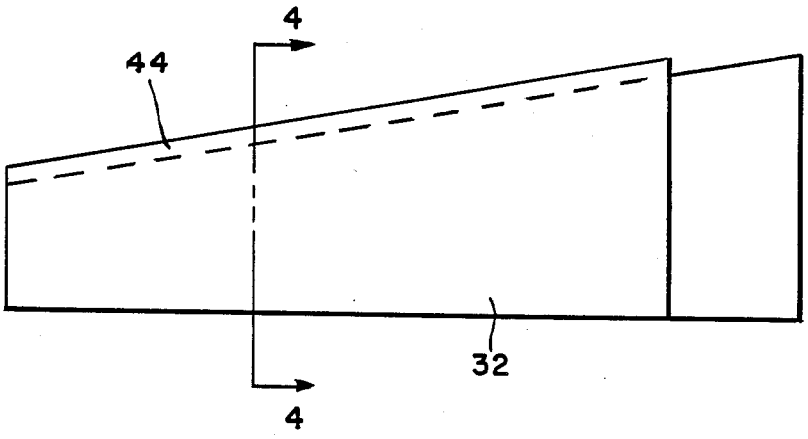
FIG. 3 is an elevational view of a wedge member by itself of the present invention.
Figure 4:
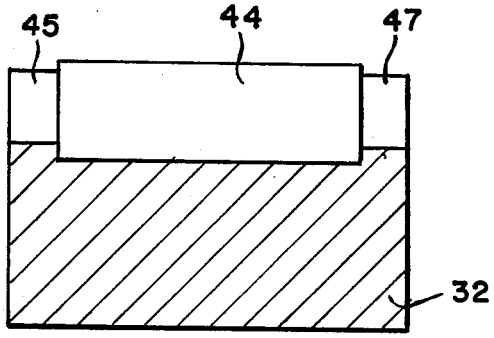
FIG. 4 is a cross-sectional view taken along lines 4—4 of FIG. 3.

The placement of plates 36, 38 is best shown in FIG. 2, as is the construction of top surface of wedge member 32, which top surface of wedge member 32 has a groove 44 in a U-configuration as best shown in FIGS. 3 and 4. The inner sloped surface 26 of slot 16 enters this U-groove 44 of the top surface of wedge member 32 when wedge member 32 is slid down into this sloped surface area against breaker bar 14.

As can be particularly seen in the FIGS. 1 and 2, the thicker end of wedge member 32 situated near tubular sleeve 34 has less of a width than that section of wedge member 32 containing the U-groove 44 (FIGS. 3 and 4). This dimension for the width of wedge member 32 is selected to correspond to the thickness of disc plate 10 as shown in FIG. 2, where disc plate 10 is shown to be seated in the U-groove of wedge member between its ledges 45 and 47. Any clearance existing between the thicker end of wedge member 32 and the bottom of the semi-circular enlarged area 30 is taken up by tubular sleeve 34 whose thickness with respect to its wall diameter is selected accordingly.

Tubular sleeve 34 initially prior to the operation of the impact crusher supports wedge member 32 in its predetermined positioning in the slot 16 against breaker bar 14 (FIG. 1).

Retainer plates 36 and 38 abut the opposed faces 46, 48 of disc plate 10 and their dimension is such that they fit substantially over the semi-circular enlargement area 30 of slot 16 and overlap wedge member 32 at its thicker end having the lesser width dimension than its remaining portion. As FIG. 2 shows, the thickness of retainer plates 36 and 38 are substantially the same as that of ledges 45 and 47 of the U-groove 44 in wedge member 32. The diameter of bolt 42 is selected to be smaller than the central opening in sleeve 34 and to provide support to sleeve 34, which, in turn, is supported by a part of the arcuate surface in the enlargement area 30 of slot 16. The design provides for the use of sleeves of different thicknesses which are used to compensate for conditions such as manufacturing errors and the dimension of the wedge 32, the slot 16, and the breaker bar 14 so that the desired relationship between these members can be easily obtained.

Retainer plates 36 and 38 and U-groove 44 prevent wedge member 32 from moving in a lateral direction parallel to the axis of shaft 12, and sleeve 34 and bolt 42 limits the wedge member's movement in a radial direction toward shaft 12, while still permitting wedge member 32 to move out of slot 16 in a radial direction away from shaft along and against the adjacent longitudinal surface of breaker bar 14 as indicated by the arrow.

In the instance of this latter movement which occurs upon rotation of shaft 12 with disc 10 due to the developed centrifugal forces, the holding force of wedge member 32 against breaker bar 14 naturally increases thereby improving and assuring the proper positioning of breaker bar 14 in slot 16 and, thus, improving and enhancing the efficiency of the impact of breaker bar against the material particulates in the disintegrating operation.

Removal of wedge member 32 involves removal first of the nut 40 and bolt 42, which loosens retainer plates 36, 38 away from disc plate 10, thereby permitting sleeve 34 to be removed. Wedge member 32 is pushed inwardly toward the bottom surface of the enlarged area 30 of slot 16 to clear it away from breaker bar 14, which is then handled either manual or mechanically for its removal or reregistration with back-up bar 22.

Whereas the particular embodiment of the present invention has been described above for purposes of illustration, it will be evident to those skilled in the art that numerous variations of the details may be made without departing from the invention as defined in the attached claims, and that the invention may be used with other types of machines and applications where it is desirable to control the movement of a wedge and yet provide for its quick and efficient removal and replacement, and hence, an element similar to the breaker bar 14 herein discussed. In the instance where the wedge member 32 is loosened from the breaker bar and back-up bar by a sudden force applied to the outermost end of the wedge 32 the extent of inward movement of wedge 32 in slot 16 will be limited by the base of the opening 30, the depth of which is designed such that the breaker bar 14 is free from the back-up bar 22.

In this connection, it will also be noted that there exists correlation between the depth of the cut outs 18, 20 in the breaker bar 14 for the back-up bar 22 and the operative and inoperative positioning of the wedge 32, whereby the size of the opening 30 assures that the wedge 32 can be moved to its inoperative inward positioning sufficient to allow the thickest part of the breaker bar 14 to freely pass into and out of the slot 16. To better appreciate this, if breaker bar 14 as shown in FIG. 1 is at a 9:00 position instead of the 3:00 position shown, and the wedge is in its operative positioning out of the slot 16, the breaker bar 14 would fall away from the back-up bar 22 and be free to slide out of the slot 16 whereas in its operative positioning the wedge element 32 supports the breaker bar 32 in slot 16.

In accordance with the provisions of the patent statutes, I have explained the principle and operation of my invention and have illustrated and described what I consider to represent the best embodiment thereof.

I claim:

1. A rotor assembly for use in a crushing machine for reducing material, such as limestone, grain, and ore comprising:

a rotatably mounted shaft, at least one disc fixedly mounted on said rotatable shaft for rotation therewith, having an outer peripheral surface with opposed outer faces extending radially outwardly from said shaft, in which surface there is located at least one slot, breaker bar means arranged parallel to the axis of said shaft received in said slot in said disc, and extending radially outwardly from said slot for contacting and impacting against said material, a wedge member arranged in said slot of said disc between an associated surface of said disc and said breaker bar means for engagement therebetween, said surface of said disc cooperating with an engaging surface of said wedge member so that any movement of the wedge member outwardly from said slot in a radial direction increases the holding force between said wedge member and said breaker bar means, said slot having an enlargement located inwardly from where said wedge member is arranged, and clamping means for said wedge member associated with said enlargement in said slot, said clamping means comprising:

elongated means having opposed ends and which is insertable longitudinally in said enlargement of said slot for engagement with said wedge member, and a restraining member mounted at each said opposed end of said elongated means and constructed and arranged to abut said adjacent surfaces of said disc and to overlap a portion of said wedge member for limiting the movement of said wedge member in a direction perpendicular to said radial direction but allowing relative movement between said clamping means and said wedge member, said elongated means including restricting means extending through said restraining members associated with said slot in said enlargement for contact by said wedge member in said slot in an initial positioning in a manner that upon operation of said rotor assembly the centrifugal force causes said wedge member to slide out of said initial positioning in said radial direction away from said enlargement of said slot for increasing the holding force of said wedge member against said breaker bar means.

2. A rotor assembly according to claim 1, wherein said wedge member has a groove along said engaging surface for receiving an edge of said disc, said groove having surfaces overlapping portions of said opposed outer faces of said disc along its said edge thereby assisting in said limiting of said movement of said wedge member in said perpendicular direction.

3. A rotor assembly according to claim 1, wherein said restricting means consists of an elongated member, and said elongated means further includes a sleeve mounted on said elongated member in said enlargement of said slot.

4. A rotor assembly according to claim 1, wherein said wedge member has a thicker end portion constructed to become engageable with said elongated means.

5. A rotor assembly according to claim 1, wherein said restricting means consists of an elongated member and further comprises means for varying the thickness of said elongated member consisting of a tubular member having a preselected diameter arranged around said elongated member in said enlargement of said slot.

6. A rotor assembly according to claim 1, further comprising:

back-up bar means for said breaker bar constructed and arranged to have at least a portion projecting in said slot of said disc and extending parallel to the axis of said shaft and to said breaker bar means in supporting engagement with one side thereof, and wherein said enlargement of said slot has a surface for supporting said elongated means such that upon said removal of said clamping means, said wedge member can be slid into said enlargement thereby clearing said breaker bar means from said back-up bar for removal from said slot of said disc.

7. A rotor assembly according to claim 6, wherein said breaker bar has cut-outs for encircling said back-up bar means, and wherein said enlargement of said slot has a correlation with the depth of each of said cut-outs such that said wedge can be moved into said enlargement thereby allowing sufficient room to allow said breaker bar to be easily inserted and removed from said slot.

8. In a crushing machine for reducing material such as limestone, grain, and ore, comprising:

a support member subjected to centrifugal force during the operation of said crushing machine, and having an outer peripheral surface with opposed outer faces and extending outwardly from its center in which surface there is located at least one slot, breaker bar means received in said slot in said support member, and extending outwardly from said slot for contacting and impacting against said material, a wedge member arranged in said slot of said support member between an associated surface of said support member and said breaker bar means for engagement therebetween for applying a holding force against said breaker bar means surface of said wedge member formed such that any movement of said wedge member in an outward direction from said slot increases the holding force of said wedge member against said breaker bar means, which said movement is normally caused by said centrifugal force during said operation of said crushing machine, said slot having an enlargement located inwardly from where said wedge member is arranged, and clamping means for said wedge member associated with said enlargement in said slot, said clamping means comprising:

elongated means having opposed ends which is insertable longitudinally in said enlargement of said slot for engagement with said wedge member, and a restraining member mounted at each said opposed end of said elongated means and constructed and arranged to abut a said opposed face of said support member and to overlap a portion of said wedge member for limiting the movement of said wedge member in a direction perpendicular to said outward direction but allowing relative movement between said clamping means and said wedge member parallel to said outward direction, said elongated means including restricting means extending through said restraining members associated with said enlargement of said slot for contact by said wedge member in said slot in an initial positioning in a manner that upon operation of said rotor assembly said centrifugal force causes said wedge member to move out of its initial positioning in said outward direction away from said enlargement of said slot for increasing the holding force of said wedge member against said breaker bar means.

9. In a crushing machine according to claim 8, wherein said wedge member has a groove along the surface abutting said support member for receiving an edge of said support member, said groove having surfaces overlapping portions of said opposed outer faces of said support member along its said edge thereby assisting in said limiting of said movement of said wedge member in said perpendicular direction.

10. In a crushing machine according to claim 8, wherein said restricting means consists of an elongated member, and said elongated means further includes a sleeve mounted on said elongated member in said enlargement of said slot.

11. In a crushing machine according to claim 8, wherein said wedge member has a thicker end portion constructed to become engageable with said elongated means.

12. In a crushing machine according to claim 8, wherein said restricting means consists of an elongated member, and further comprises means for varying the thickness of said elongated member consisting of a sleeve having a preselected diameter arranged around said elongated member in said enlargement of said slot.

* * * * *